US009517483B1

(12) United States Patent
Derman

(10) Patent No.: US 9,517,483 B1
(45) Date of Patent: Dec. 13, 2016

(54) PUMP DISPENSER FOR A FLEXIBLE PRESS-ON CONTAINER LID

(71) Applicant: Jay S. Derman, Temecula, CA (US)

(72) Inventor: Jay S. Derman, Temecula, CA (US)

( * ) Notice: Subject to any disclaimer, the term of this patent is extended or adjusted under 35 U.S.C. 154(b) by 0 days.

(21) Appl. No.: 15/198,139

(22) Filed: Jun. 30, 2016

Related U.S. Application Data

(60) Provisional application No. 62/342,969, filed on May 29, 2016.

(51) Int. Cl.
*B65D 88/54* (2006.01)
*B05B 11/00* (2006.01)
*B65D 43/02* (2006.01)

(52) U.S. Cl.
CPC ..... *B05B 11/3001* (2013.01); *B05B 11/3047* (2013.01); *B65D 43/0204* (2013.01)

(58) Field of Classification Search
CPC ..... B05B 11/0013; B05B 11/001; B05B 11/0005; B05B 11/3001; B05B 11/3047; B05B 11/3045; B65D 43/0204
USPC ..... 222/321.7–321.9, 321.1, 464.1, 498, 499,222/553
See application file for complete search history.

(56) References Cited

U.S. PATENT DOCUMENTS 4,773,553 A * 9/1988 Van Brocklin ..... B05B 11/3049 215/272
6,135,326 A * 10/2000 Lee ..... B05B 11/3023 222/321.9
9,199,783 B2 * 12/2015 Wanbaugh ..... B05B 11/3047

FOREIGN PATENT DOCUMENTS

DE 102009003877 A1 * 11/2010
FR 2918964 A1 * 7/2007

OTHER PUBLICATIONS

Factory Direct Craft; web capture <http://factorydirectcraft.com/catalog/products/2030_2213-14351-galvanized_makeyourown_dispenser_kit.html>: Springboro, Ohio, US; captured on Sep. 1, 2016.

* cited by examiner

*Primary Examiner* — Lien Ngo
(74) *Attorney, Agent, or Firm* — Aaron P. McGushion

(57) ABSTRACT

A pump dispenser assembly is provided with a rigid or semi-rigid container having a mounting bead at the rim, a flexible lid with an annular mounting portion for gripping the mounting bead, a rigid member laid atop the flexible lid and spanning the rim of the container, and a fluid pump inserted through aligned holes through the flexible lid and rigid member. With this arrangement, a fluid can be pumped out from within the container, without substantial flexing of the flexible lid under the pumping force.

20 Claims, 4 Drawing Sheets

28
26
22
54
70
46
20
24
8
28
26
22
L 34
28
9
22
36
38
58
26

72
26
58
38
36
34
22
28'
72

PUMP DISPENSER FOR A FLEXIBLE PRESS-ON CONTAINER LID

RELATED APPLICATION DATA

This application claims the priority date of provisional application No. 62/342,969 filed on May 29, 2016, which is herein incorporated by reference in its entirety.

BACKGROUND

Many people prefer to repackage store-bought liquid products or neatly package homemade liquid products within attractive containers, such as glass or metal containers. Some of these containers have a flexible lid or other form of flexible closure, where at least the panel (the center area in the top of the cap) is flexible, even if the threaded skirt area is more rigid. A common form of flexible lid is the press-on or snap-on lid, where the lid is flexible so that the lid can be deformed to engage the rim of a rigid or semi-rigid container. For example, the container may be relatively rigid compared to the flexible lid, such as a rigid paper or plastic container or the like, or a glass, ceramic, porcelain, or metal container.

Once a liquid is repackaged in a container with a flexible lid, the user may wish to dispense the liquid using a fluid pump, to eject the liquid in fluid or foam form upon depression of the fluid pump. If the user were to form a hole through the flexible lid for mounting the fluid pump thereon, upon each depression of the fluid pump, the panel of the lid would deflect down towards the interior of the container, absorbing much or all of the energy intended to pump liquid from the container, resulting in severely reduced liquid flow. A device is needed that permits a user to us a fluid pump on a wide variety of containers compatible with flexible lids.

SUMMARY

The present support device provides a pump dispenser assembly comprising a container having an annular rim with a mounting bead, a sidewall, and a bottom for defining an interior; a flexible lid with an annular mounting portion for releasable mounting on the container by engagement of the mounting bead of the annular rim, with a first hole formed through the flexible lid, a bottom surface, and a top surface; a rigid member positioned above the top surface of the flexible lid, where the rigid member spans the container so that the rigid member is supported by opposing sides of the annular rim, a second hole formed through the rigid member; a fluid pump having an actuator, a threaded closure supporting the actuator, a cylinder beneath the actuator, and a dip tube extending from the cylinder and in fluid communication with the actuator through the cylinder, in an assembled configuration the cylinder being inserted through the first hole and the second hole with the threaded closure above the top surface, the dip tube extending into the interior; and a threaded collar positioned beneath bottom surface of the flexible lid, in the assembled configuration the threaded collar tightened to the threaded closure to sandwich the flexible lid to the rigid member so that a pumping force on the actuator is transferred through the rigid member and to the container through the annular rim to prevent substantial deflection of the flexible lid.

In an alternate embodiment, the threaded collar further comprises an annular shoulder and a male thread extending from the annular shoulder, where in the assembled configuration the male thread attaches to a female thread of the threaded closure. A gasket may positioned between the annular shoulder and the bottom surface of the flexible lid, where in the assembled configuration the gasket is seals between the annular shoulder and the bottom surface. The flexible lid may be a detachable press-on lid with an inner annular ridge for gripping to the mounting bead. The flexible lid may be a detachable press-on lid with an inner annular ridge for gripping to the mounting bead and the container is substantially rigid.

Alternatively, the rigid member is a circular plate. The plate diameter is sufficient to span beyond an inner diameter of the annular rim of the container. And, the plate diameter may be greater than an outer diameter of the annular rim of the container. An annular skirt may be formed about the outer diameter of the plate so that in the assembled configuration the annular skirt substantially obscures the annular mounting portion of the lid from view. A graphic sheet may be included with a decorative graphic applied thereto and with a third hole formed therethrough. The third hole may sufficiently large to fit over the actuator and the threaded closure.

In an alternative embodiment, pump dispenser assembly is provided, comprising a container having a lid mounting means about an opening, a sidewall, and a bottom for defining an interior; a flexible lid with container mounting means for releasable mounting on the container by engagement to the lid mounting means, a bottom surface, and a top surface; a pump supporting means spanning the opening of the of the container so that a pumping force is transferred through the pump supporting means and to the container to prevent substantial deflection of the flexible lid; a fluid pumping means having an actuator, in an assembled configuration the fluid pumping means being inserted through the flexible lid and the pump supporting means; a pump retaining means, in the assembled configuration the pump retaining means being attached to the fluid pumping means to hold the flexible lid and the pump supporting means between the pump retaining means and the fluid pumping means.

Figure 2:
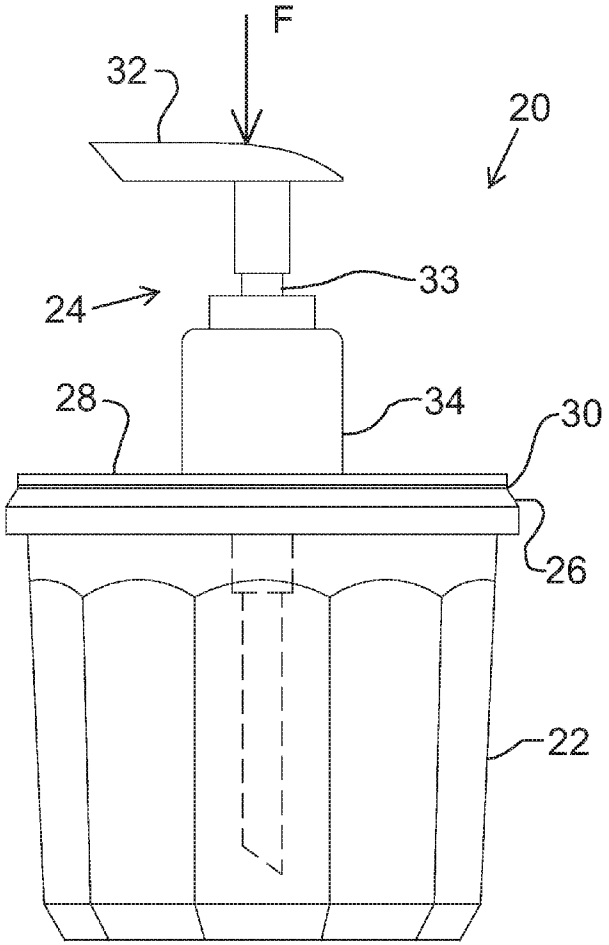
FIG. 2 is side view of the embodiment of FIG. 1 illustrating a pumping force applied.
Figure 1:
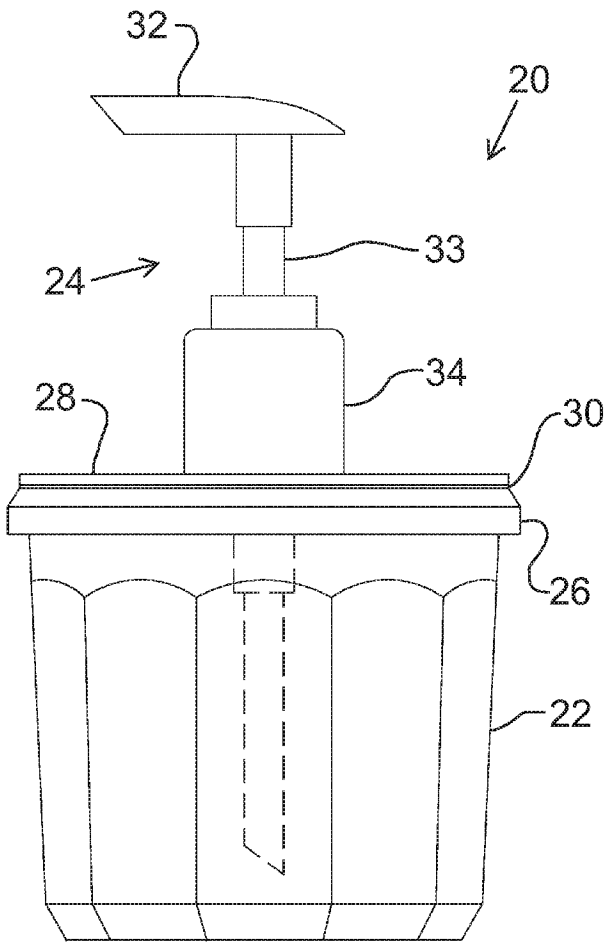
FIG. 1 is a side view of the present pump dispenser assembly.

LISTING OF REFERENCE NUMERALS
of FIRST-PREFERRED EMBODIMENT

| | |
|---|---|
| pump dispenser assembly | 20 |
| container | 22 |
| fluid pump | 24 |
| flexible lid | 26 |
| rigid member or plate | 28, 28' |
| graphic sheet | 30 |
| actuator | 32 |
| stem | 33 |
| threaded closure | 34 |
| cylinder | 36 |
| dip tube | 38 |
| sidewall | 40 |
| bottom | 42 |
| annular rim | 44 |
| mounting bead | 46 |
| hole | 48, 50, 52 |
| annular mounting portion | 54 |
| panel | 55 |
| top surface | 56 |
| threaded collar | 58 |
| annular shoulder | 60 |
| male thread | 62 |
| knurled grip | 64 |
| interior | 66 |
| passage | 68 |
| inner annular ridge | 70 |
| annular skirt | 72 |
| circular groove | 74 |
| pumping force | F |
| liquid | L |

DESCRIPTION OF THE PREFERRED EMBODIMENTS

The detailed descriptions set forth below in connection with the appended drawings are intended as a description of embodiments, and is not intended to represent the only forms in which the present securement system may be constructed and/or utilized. The descriptions set forth the structure and the sequence of steps for constructing and operating the securement system in connection with the illustrated embodiments. It is to be understood, however, that the same or equivalent structures and steps may be accomplished by different embodiments that are also intended to be encompassed within the spirit and scope of the invention.

FIGS. 1-10 illustrate example embodiments of the present pump dispenser assembly (20). Looking first at FIGS. 1-2, the pump dispenser assembly (20) is illustrated as generally having a rigid or semi-rigid container (22), a flexible lid (26) which snaps-on to the container (22), a fluid pump (24), and a rigid member (28) spanning the top panel (55) of the flexible lid (26) and annular rim (44) of the container (22) so that the downward movement of the fluid pump (24) is substantially eliminated when a pumping force (F) is applied to the fluid pump (24). A graphic sheet (30) is shown inserted between the flexible lid (26) and the rigid member (28), but is optional and may also be placed atop the rigid member (28).

In this example the rigid member (28) is a circular flat disk, but may be any number shapes, such as an elongated strip, triangle, square, etc. No matter the shape, the rigid member (28) should span the rim (44) of the container (22) so that the pumping force (F) is distributed through the rigid member (28) and into the container (22) without substantial deformation of the flexible lid (26). The rigid member (28) may be made of a suitable material that resists substantial deflection under normal pumping force (F), but may deflect somewhat, such as by 0-15% of the fluid pump displacement, where much of the energy is still dedicated to pumping the contained liquid (L). Some materials may include clear or opaque plastic, a metal material, or other material having one or more of a composition, thickness, or cross sectional shape to substantially resist deflection from at least the direction of the pump (24) displacement. Cross-sectional shapes may include an I, U, or C-shape. In one example, the rigid member (28) is circular, flat sheet of thermoplastic, with a thickness of approximately 0.050" and 0.20", although other thicknesses are available in the present design. If the graphic sheet (30) is positioned under the rigid member (28), the rigid member (28) may be made of a clear plastic so that any graphic printed or applied to the graphic sheet (30) may be viewed through the rigid member (28). A graphic may be applied or printed to both sides of the graphic sheet (30) so that the graphic sheet (30) may be flipped to change the visible design. The graphic sheet (30) need not provide support in addition to the rigid member (28), but may still act to reinforce the rigid member (28) slightly.

Figure 3:
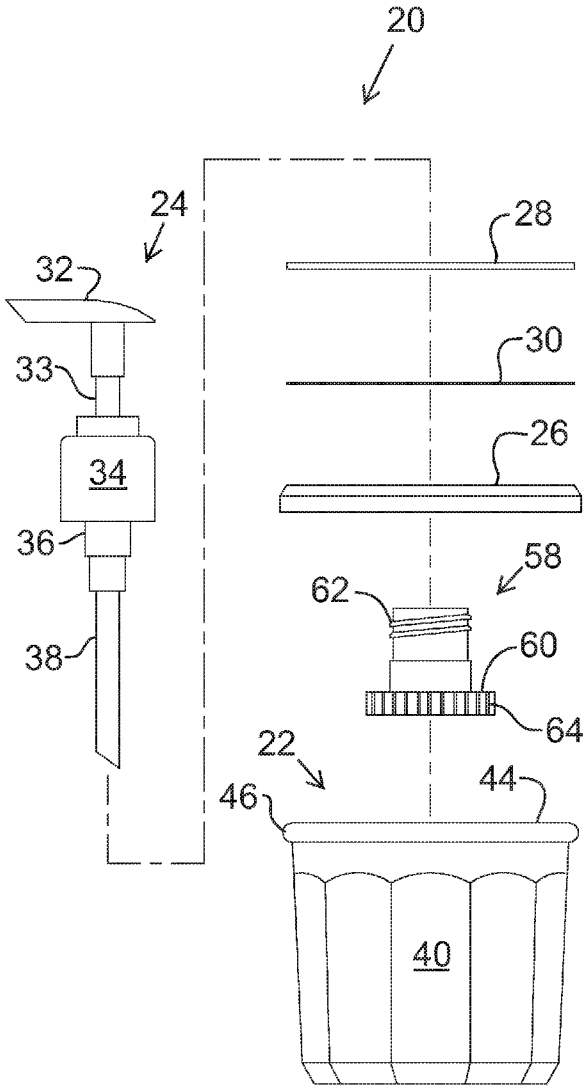
FIG. 3 is an exploded side view of the embodiment of FIG. 1.
Figure 4:
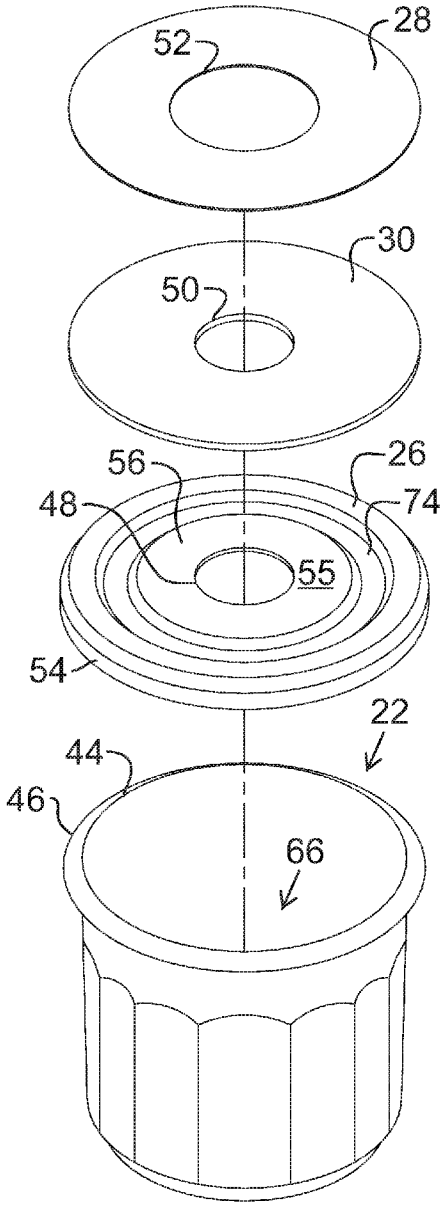
FIG. 4 is an exploded perspective view of the embodiment of FIG. 1.
Figure 6:
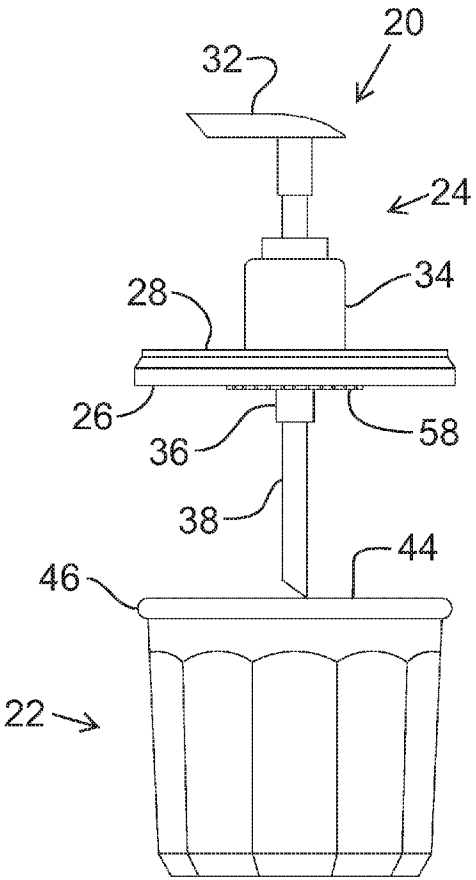
FIG. 6 is a partially assembled side view of the embodiment of FIG. 1.
Figure 5:
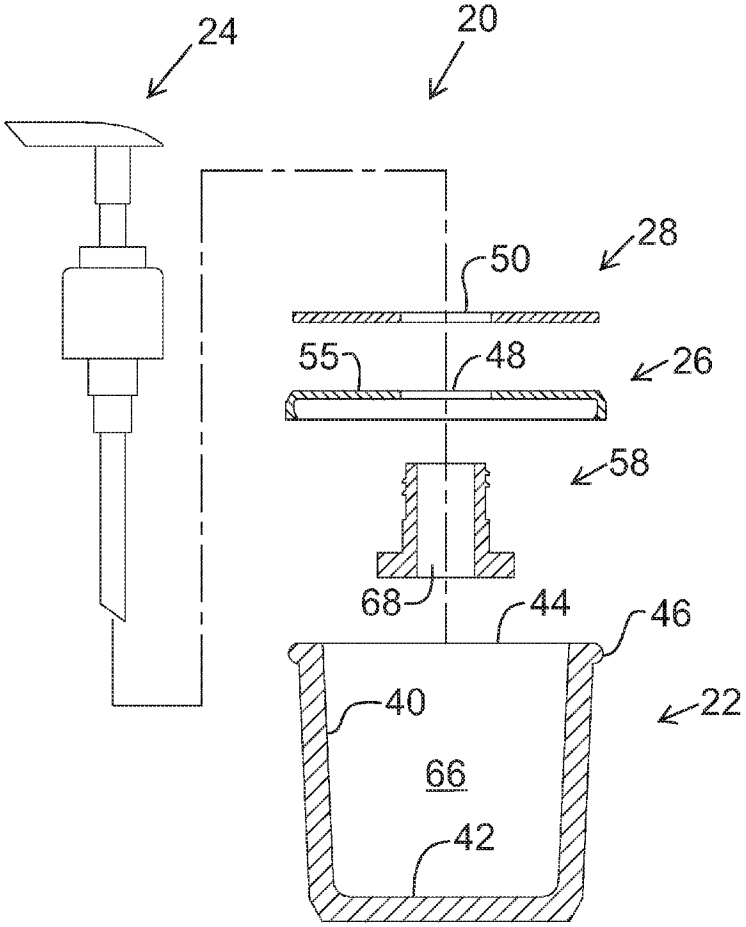
FIG. 5 is an exploded cross-sectional view of the embodiment of FIG. 1, taken along a central axis.

Looking at FIGS. 3-5, the fluid pump (24) generally comprises a closure (34) (a threaded closure in this example) supporting an upwardly extending stem (33) with an actuator (32) at its terminus. Extending downward from the closure (34) is a cylinder (36) having a dip tube (38) connected thereto. The stem (33) is permitted to travel up and down through the cylinder (36), forming a pump arrangement, where the stem (33) is biased upward by an internal spring.

A series of aligned through holes (48 and 50) are formed through the flexible lid (26) and the rigid member (28), with the optional graphic sheet (30) also having a through hole (52). The through hole (52) in the graphic sheet (30) may be sized sufficiently large to fit over the actuator (32) to lie atop the rigid member (28) after full assembly. When the flexible lid (26), the rigid member (28), and the optional graphic sheet (30) and stacked upon one another and the holes (48, 50, and 52) aligned, a threaded collar (58) is inserted through the holes (48, 50, and 52) with the shoulder (60) (an annular shoulder in this example) preventing the threaded collar (58) from pulling through the hole (48) in the flexible lid (26) due to the shoulder (60) being sized larger than the hole (48). A knurled grip (64) or other gripping pattern or material may be located on the perimeter of the shoulder (60) so that the user may hand-tighten the assembly as described in further detail below. There is no need to directly fasten the rigid member (28) to the flexible lid (26); the threaded collar (58) fastened to the closure (34) will generally be sufficient to hold the flexible lid (26) against the rigid member (28). In this way, the flexible lid (26) is permitted to flex relative to the rigid member (28) so that the flexible lid (26) can be bent or otherwise deformed to snap the flexible lid (26) to the container (22).

Although the graphic sheet (30) may be placed above or below the rigid member (28), the rigid member (28) should be placed on top of the flexible lid (26) to provide rigidity but not interfere with the engagement between the flexible lid (26) and the container (22). If the rigid member (28) were placed below the flexible lid (26), the flexible lid may not be able to seal correctly and fully grip the mounting bead (46) on the container (22).

Once the threaded collar (58) is inserted through the holes (48, 50, and 52), the stem (38) and cylinder (36) are inserted through the holes (48, 50, and 52) and through the passage (68) of the threaded collar (58), and the male thread (62) engaged with the female thread (not shown) of the closure (34) and hand-tightened by turning the threaded collar (58) relative to the closure (34), to tightly sandwich at least the flexible lid (26) and the rigid member (28) between the closure (34) and the annular shoulder (60) of the threaded collar (58). An optional gasket such as an O-ring, a flange gasket, or the like, can be fitted between the annular shoulder (60) and the bottom surface of the flexible lid (26). Although the engagement between the threaded collar (58) and the closure (34) is illustrated as a threaded engagement, other forms of engagement are possible, such as a snap together arrangement, glued or welded arrangement, or other engagement methods that are permanent or detachable.

The flexible lid (26) illustrated in FIG. 4 is an example lid with a circular groove (74) formed on the panel (55) between the center and the annular mounting portion (54), which is typical of many snap-on lids and may increase the likelihood of deformation, which further necessitates the present rigid member (28). While FIG. 5, shows a flat or planar panel (55), which also flexes to a differing degree, depending on the material and the thickness.

Figures 7, 8, 9, 10:
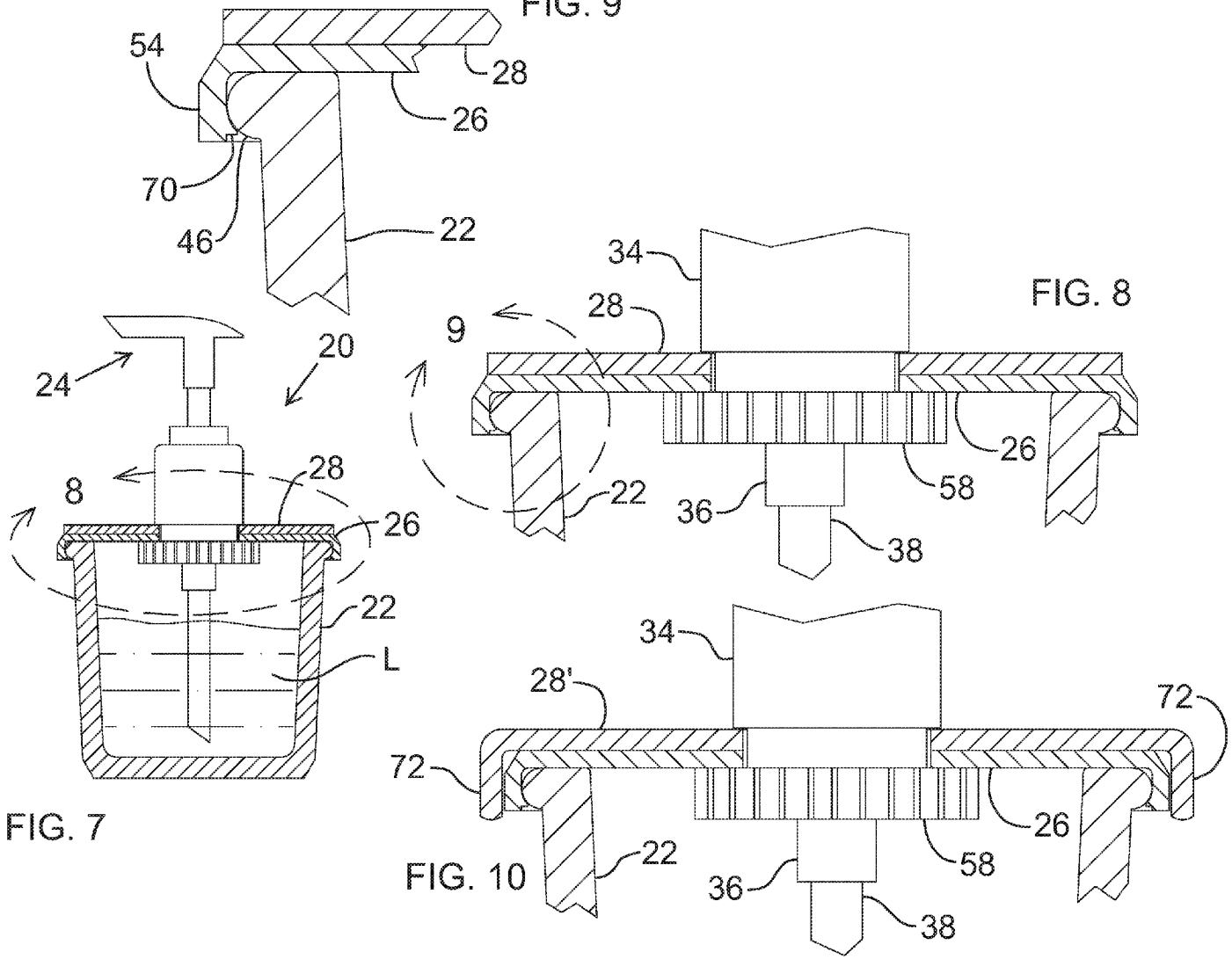
FIG. 7 is an assembled partial cross-section side view of the embodiment of FIG. 1.
FIG. 8 is a partial magnified view of FIG. 7.
FIG. 9 is a partial magnified view of the of FIG. 8.
FIG. 10 is an assembled magnified sectional view of an alternate embodiment of the present pump dispenser assembly.

Further viewing FIG. 5, the container (22) has a sidewall (40) and a bottom (42) defining an interior (66) capable of containing a liquid (L), as shown in FIG. 7. An annular rim (44) defines an opening of the container with a mounting bead (46 formed at the rim (44). The container (22) may be any number of suitable containers, such as, but not limited to, a working glass, a rigid paper or plastic cup, a ceramic cup, an old fashioned glass, lowball glass, rocks glass, highball glass, Collins glass or other glass tumbler, a metal container or other container with a rolled lip. The container can be of various heights, diameters, and capacities.

FIGS. 7-9, show an exemplary annular mounting portion (54) of the flexible lid (26), with an inner annular ridge (70) formed about the inside of the annular mounting portion (54), and is configured to capture the mounting bead (46) between the panel and the inner annular ridge (70) to secure the flexible lid (26) to the container (22). The rigid member (28) (a disk in this example) is shown spanning the annular rim (44) of the container (22), so that the pumping force (F) is distributed to the container (22) through the rim (44), without substantial deflection of the flexible lid (26).

FIG. 10 illustrates an alternate embodiment of the present rigid member (28). Instead of being a flat disk, this example rigid member (28') has a flat disk portion with an annular skirt (72) formed about the perimeter. The annular skirt (72) is sufficiently wide to obscure the lid from view, creates a pleasant look, and can serve to prevent substantial lateral movement of the rigid member (28') relative to the flexible lid (26).

User may place a wide variety of liquids (L) in the present pump dispenser assembly (20), including soaps, water and other drinks, soups, syrups, creams, lotions, oils, perfumes, sprays, gels, including hair and shower gels, contents of pressurized containers, including shaving foam, other foams and deodorants, pastes, such as toothpaste, liquid-solid mixtures, suspensions, mascara, or any other composition of a consistency appropriate for pumping.

While particular forms of the present securement system have been illustrated and described, it will also be apparent to those skilled in the art that various modifications can be made without departing from the spirit and scope of the design. Accordingly, it is not intended that the invention be limited except by the claims.

What is claimed is:

1. A pump dispenser assembly comprising:

a container having an annular rim with a mounting bead, a sidewall, and a bottom for defining an interior;

a flexible lid with an annular mounting portion for releasable mounting on the container by engagement of the mounting bead of the annular rim, a first hole formed through the flexible lid, a bottom surface, and a top surface;

a rigid member positioned above the top surface of the flexible lid, the rigid member spanning the container so that the rigid member is supported by opposing sides of the annular rim, a second hole formed through the rigid member;

a fluid pump having an actuator, a threaded closure supporting the actuator, a cylinder beneath the actuator, and a dip tube extending from the cylinder and in fluid communication with the actuator through the cylinder, in an assembled configuration the cylinder being inserted through the first hole and the second hole with the threaded closure above the top surface, the dip tube extending into the interior; and a threaded collar positioned beneath bottom surface of the flexible lid, in the assembled configuration the threaded collar tightened to the threaded closure to sandwich the flexible lid to the rigid member so that a pumping force on the actuator is transferred through the rigid member and to the container through the annular rim to prevent substantial deflection of the flexible lid.

2. The pump dispenser assembly of claim 1 wherein the threaded collar further comprises an annular shoulder and a male thread extending from the annular shoulder, where in the assembled configuration the male thread attaches to a female thread of the threaded closure.

3. The pump dispenser assembly of claim 2 wherein a gasket is positioned between the annular shoulder and the bottom surface of the flexible lid, where in the assembled configuration the gasket is seals between the annular shoulder and the bottom surface.

4. The pump dispenser assembly of claim 1 wherein the flexible lid is a detachable press-on lid with an inner annular ridge for gripping to the mounting bead.

5. The pump dispenser assembly of claim 1 wherein the flexible lid is a detachable press-on lid with an inner annular ridge for gripping to the mounting bead and the container is substantially rigid.

6. The pump dispenser assembly of claim 1 wherein the rigid member is a plate.

7. The pump dispenser assembly of claim 6 wherein the plate is circular.

8. The pump dispenser assembly of claim 7 wherein a plate diameter is sufficient to span beyond an inner diameter of the annular rim of the container.

9. The pump dispenser assembly of claim 8 wherein the plate diameter is greater than an outer diameter of the annular rim of the container.

10. The pump dispenser assembly of claim 9 wherein an annular skirt is formed about the outer diameter of the plate so that in the assembled configuration the annular skirt substantially obscures the annular mounting portion of the lid from view.

11. The pump dispenser assembly of claim 1 further comprising a graphic sheet having a decorative graphic applied thereto and with a third hole formed therethrough.

12. The pump dispenser assembly of claim 11 wherein the third hole is sufficiently large to fit over the actuator and the threaded closure.

13. A pump dispenser assembly comprising:

a container having an annular rim with a mounting bead, a sidewall, and a bottom for defining an interior;

a flexible lid with an annular mounting portion for releasable mounting on the container by engagement of the mounting bead of the annular rim, a first hole formed through the flexible lid, a bottom surface, and a top surface;

a round rigid plate positioned above the top surface of the flexible lid, the round rigid plate spanning the container so that the round rigid plate is supported by opposing sides of the annular rim, a second hole formed through the round rigid plate;

a fluid pump having an actuator, a threaded closure supporting the actuator, a cylinder beneath the actuator, and a dip tube extending from the cylinder for delivering a fluid to the actuator through the cylinder, in an assembled configuration the cylinder being inserted through the first hole and the second hole with the threaded closure above the top surface, the dip tube extending into the interior; and a threaded collar positioned beneath bottom surface of the flexible lid, in the assembled configuration the threaded collar tightened to the threaded closure to sandwich the flexible lid to the round rigid plate so that a pumping force on the actuator is transferred through the rigid member and to the container through the annular rim to prevent substantial deflection of the flexible lid.

14. The pump dispenser assembly of claim 13 wherein an annular skirt is formed about the outer diameter of the round rigid plate so that in the assembled configuration the annular skirt substantially obscures the annular mounting portion of the lid from view.

15. The pump dispenser assembly of claim 13 wherein the threaded collar further comprises an annular shoulder and a male thread extending from the annular shoulder, where in the assembled configuration the male thread attaches to a female thread of the threaded closure.

16. The pump dispenser assembly of claim 13 further comprising a round graphic sheet having a decorative graphic applied thereto to at least one side and with a third hole formed therethrough.

17. The pump dispenser assembly of claim 16 wherein the third hole is sufficiently large to fit over the actuator and the threaded closure.

18. A pump dispenser for attachment a container having a mounting bead about an opening, a sidewall, and a bottom for defining an interior, the pump dispenser comprising:

a flexible lid with an annular mounting portion for releasable mounting on the container by engagement to the mounting bead, a hole formed through the flexible lid, a bottom surface, and a top surface;

a rigid member positioned above the top surface of the flexible lid and spanning the opening of the of the container so that a pumping force is transferred through the rigid member and to the container to prevent substantial deflection of the flexible lid;

a fluid pump having an actuator, in an assembled configuration the fluid pump being inserted through the hole of the flexible lid and through the rigid member; and a detachable collar positioned beneath bottom surface of the flexible lid, in the assembled configuration the detachable collar being selectively attached to the fluid pump to hold in compression the flexible lid and the rigid member between the collar and the fluid pump so that a pumping force on the actuator is transferred through the rigid member and to the container through the mounting bead to prevent substantial deflection of the flexible lid.

19. The pump dispenser of claim 18 wherein the rigid member is a plate.

20. The pump dispenser of claim 18 wherein the fluid pump further comprises a threaded closure supporting the actuator, a cylinder beneath the actuator, and a dip tube extending from the cylinder and in fluid communication with the actuator through the cylinder, and the detachable collar is threaded for mating to the threaded closure.

* * * * *